US006837775B2

(12) United States Patent
Anand et al.

(10) Patent No.: US 6,837,775 B2
(45) Date of Patent: Jan. 4, 2005

(54) POROUS, LUBRICATED MIXING TUBE FOR ABRASIVE, FLUID JET

(76) Inventors: Umang Anand, 3501 St. Paul St., Apt. 914, Baltimore, MD (US) 21218; Joseph Katz, 130 Starhill La., Baltimore, MD (US) 21228

( * ) Notice: Subject to any disclaimer, the term of this patent is extended or adjusted under 35 U.S.C. 154(b) by 0 days.

(21) Appl. No.: 10/010,663

(22) Filed: Dec. 6, 2001

(65) Prior Publication Data

US 2003/0109206 A1 Jun. 12, 2003

(51) Int. Cl.[7] ..... B24B 1/00
(52) U.S. Cl. ..... 451/38; 451/40; 451/102
(58) Field of Search ..... 451/38, 39, 36, 451/37, 75, 28, 102, 449, 56, 40

(56) References Cited

U.S. PATENT DOCUMENTS

| | | | | |
|---|---|---|---|---|
| 4,555,872 A | * | 12/1985 | Yie | 451/40 |
| 4,648,215 A | * | 3/1987 | Hashish et al. | 451/40 |
| 4,707,952 A | | 11/1987 | Krasnoff | |
| 5,018,317 A | * | 5/1991 | Kiyoshige et al. | 451/102 |
| 5,320,289 A | * | 6/1994 | Hashish et al. | 239/434 |
| 5,505,653 A | | 4/1996 | Nedo et al. | |
| 5,626,508 A | | 5/1997 | Rankin et al. | |
| 5,785,582 A | | 7/1998 | Stefanik et al. | |
| 5,860,849 A | | 1/1999 | Miller | |
| 5,921,846 A | | 7/1999 | Katz | |
| 6,012,653 A | | 1/2000 | Gunther et al. | |
| 6,077,152 A | | 6/2000 | Warehlme | |
| 6,425,805 B1 | * | 7/2002 | Massa et al. | 451/40 |

OTHER PUBLICATIONS

Anand & Katz, Using Porous Lubricated Nozzle To Prevent Nozzle Wear In Abrasive Water Suspension Jets, Aug. 18, 2001, Proceedings Of the 11$^{th}$ American Water Jet Conference, Minneapolis, MN.

* cited by examiner

*Primary Examiner*—Dung Van Nguyen
(74) *Attorney, Agent, or Firm*—Larry J. Guffey

(57) ABSTRACT

An abrasive, fluid jet cutting apparatus, and its method of construction and operation, are disclosed that reduce the wear and erosion problems typically experienced in the cutting jet's mixing tube. This improved fluid jet cutting apparatus comprises (a) a chamber having an inlet for receiving a pressurized fluid jet, a port for receiving a flow of abrasive particles which are entrained into the fluid jet, and an exit through which the fluid jet and entrained abrasives exit the chamber, (b) a mixing tube having an entry port for receiving said fluid jet and entrained abrasives, an inner wall for directing the flow of said fluid jet and entrained abrasives, and an outlet port through which said fluid jet and entrained abrasives exit said tube, wherein the tube entry port is proximate the chamber exit, (c) a lubricating fluid reservoir that surrounds at least a portion of the outer wall of the mixing tube, (d) wherein at least a portion of the mixing tube wall is porous, and (e) wherein the lubricating fluid passes from the lubricating reservoir and through the porous wall to lubricate at least a portion of the surface of the mixing tube wall so as to resist erosion of the tube wall when the fluid jet and entrained abrasives flow through the mixing tube.

48 Claims, 4 Drawing Sheets

POROUS, LUBRICATED MIXING TUBE FOR ABRASIVE, FLUID JET

BACKGROUND OF THE INVENTION

1. Field of the Invention

This invention relates to fluent abrading processes and apparatus. More particularly, this invention relates to an improved mixing or focusing tube for a high speed, abrasive, fluid jet cutting apparatus.

2. Description of the Related Art

Cutting with water is a well-known technology that has been prevalent since the 1970's. Water jet cutting is one of a number of technologies known as power beams. These include laser cutting, plasma arc cutting and oxy-acetylene gas cutting.

By utilizing a high-pressure pump to pressurize water to ultra high pressures and then forcing the water to flow through a tiny orifice can result in water jets that have velocities that are up to three times the velocity of sound. Such a focused water jet has sufficient kinetic energy to cut through most hard-to-cut materials, and when abrasives are mixed with the water flow so as to yield an abrasive water jet, one can efficiently cut almost any type of material.

Because of their greater cutting power, abrasive water jets account for nearly 60% of the water jet cutting market. Typical applications include the cutting tasks associated with fabrication of structures using extremely hard materials, such as titanium and the super-alloys, and in various mining and drilling applications where hard rocks must be cut. Meanwhile, plain water jets are used for industrial cleaning, surface preparation and paint stripping applications, and for the cutting of food products, paper and plastic materials, and woven (e.g., carpet) and nonwoven (e.g., filtration materials) products. Saline, water cutting jets have also been used in medical applications.

The primary equipment associated with a typical, abrasive water jet cutting system is shown in FIG. 1. It consists of an incoming water treatment system, a booster pump for optimal operation of downstream filters, an intensifier pump that raises the water's pressure to ultrahigh levels, high pressure plumbing that delivers the ultrahigh pressure water to the system's cutting head, an abrasive feeder system that supplies the abrasive particles that are mixed with the ultrahigh pressure water in the cutting head, and an outgoing water catcher and treatment system.

The typical cutting head for an abrasive water jet is shown in FIG. 2. A sapphire, diamond or ruby orifice is used as the initial orifice to create a high velocity water jet. The typical diameter of such orifices is 0.07–0.7 mm. A dry abrasive, such as garnet, silica or alumina (with typical particle sizes being 125–180 microns), is aspirated/entrained into the mixing chamber by the vacuum created by the water jet. It mixes with the water jet and the mixed slurry jet is then collimated by a mixing tube (also called a focusing tube) before exiting the cutting head through the mixing tube's exit orifice. The diameters of the passages through such mixing tube are 0.5–3 mm, with tube lengths of 50–150 mm.

The most troublesome difficulty associated with abrasive water jets, which presently limits their usefulness, is wear and erosion of the mixing tube walls. Since the water jet's speed ranges between 100–500 m/sec, and the abrasive particle size can be as high as 40% of the mixing tube's diameter, the mixing tubes must be replaced frequently, sometimes only a matter of hours.

Additionally, the wear of the mixing tube walls leads to the jet becoming incoherent, which causes an increase in the width of the cut (kerf) on the workpiece being cut by the jet, deterioration of cutting surface quality and loss of cutting accuracy. Hence, wear of the mixing tube walls requires constant maintenance and inspection, which leads to machine down time and increase in the operational costs of such systems.

FIG. 3 presents a schematic representation of the phenomena associated with wear of a mixing tube. Impact erosion phenomena is thought to dominate the wear in the initial portion of the mixing tube as the abrasive particles impact on the walls of the mixing tube at different impact angles. Further downstream the abrasive particles tend to travel parallel to the walls of the tube and the wear mode tends to change from impact erosion to sliding, abrasion erosion.

Present attempts to solve this wear problem include: (a) the use of mixing tubes made of very hard materials (e.g., composite tungsten carbide), (b) modifying the jet's flow structure by using an annular water jet and introducing the abrasives through a central pipe in an attempt to keep the abrasives away from the mixing tube's walls, (c) modifying the jet's flow structure by introducing the abrasives through a central pipe and having the pressurized water enter from radially inwardly directed ports whose flows combine to create a jet slurry that is focused in the mixing tube, (d) using a central deflector body prior to the mixing tube so as to create a downstream wake that helps in entraining the abrasives in the core of the water jet, (e) using abrasives that are softer than the walls of the mixing tube, and (f) attempting to configure the general shape of the mixing tube so as to minimize its wear.

All of the presently available techniques to reduce mixing tube wear have major deficiencies. The very hard materials used for mixing tubes are expensive. Modification to the jet flow structure by introducing secondary flow phenomena is useful only with relatively slow flows and small abrasive particles; such modification also causes jet expansion and secondary flow phenomena that limit one's capability to control the cutting process. The use of abrasive particles softer than the mixing tube's walls reduces cutting efficiency.

Thus, despite extensive development efforts to reduce wear in the mixing tube of a cutting jet, there exists a continuing need for further improvements in this area. The present invention provides such an improvement.

SUMMARY OF THE INVENTION

Recognizing the need for the development of an improved mixing tube which would have greater resistance to being worn away by the abrasive slurry mixtures flowing through them, the present invention is generally directed to satisfying the needs set forth above and overcoming the disadvantages identified with prior art devices.

In accordance with one preferred embodiment of the present invention, the foregoing need can be satisfied by providing an abrasive, fluid jet cutting apparatus comprising: (a) a chamber having an inlet through which a pressurized fluid jet enters the chamber, the chamber also having a port through which abrasive particles are drawn and entrained into the fluid jet, the chamber also having an exit through which the fluid jet and entrained abrasive particles exit the first chamber, (b) a mixing tube that is defined at least in part by a perimeter wall, a tube entry port and a tube exit orifice, the tube entry port being proximate the exit of the first chamber, with the fluid jet and entrained abrasive particles being mixed in the mixing tube so as to form a focused cutting jet which exits the mixing tube through its exit orifice, (c) wherein at least a portion of the mixing tube wall being porous, (d) a lubricating fluid reservoir that surrounds at least a portion of the mixing tube having the porous wall, and (e) wherein the lubricating fluid passes from the lubricating reservoir and through the porous wall to lubricate at least a portion of the surface of the mixing tube wall so as to resist erosion of the tube wall while the fluid jet and entrained abrasive particles pass through and exit from the mixing tube.

According to a second embodiment of the present invention, a method is provided for reducing wear in a cutting jet mixing tube due to an abrasive fluid flowing through the tube. The method comprises the steps of: (a) forming the mixing tube so that at least a portion of its wall is porous, (b) surrounding at least a portion of the outer wall of the mixing tube wall with a lubricating fluid reservoir, and (c) forcing lubricating fluid to pass from the lubricating reservoir and through the porous wall to form a lubricating film between the mixing tube wall and the flow of the abrasive fluid.

There has been summarized above, rather broadly, the more important features of the present invention in order that the detailed description that follows may be better understood and appreciated. In this regard, it is instructive to also consider the objectives of the present invention.

Thus, it is an object of the present invention to provide an abrasive, fluid jet cutting apparatus, and its method of construction and operation, that reduces the wear and erosion problems experienced in the cutting jet's mixing tube.

It is another object of the present invention to provide a mixing tube apparatus than can replace the mixing tubes currently used in abrasive, fluid jet cutting apparatus so as to minimize the wear and erosion problems associated with such tubes.

It is another object of the present invention to provide an abrasive, fluid jet cutting apparatus and its method of construction and operation that will expand the usefulness of such jet cutters by increasing the precision and efficiency of their cuts.

It is yet another object of the present invention to provide an abrasive, fluid jet cutting apparatus and its method of construction and operation that will expand the range of applications of such jet cutters.

It is a further object of the present invention to provide a method and device for abrasive cutting that will increase the cost effectiveness of such cutting processes.

These and other objects and advantages of the present invention will become readily apparent as the invention is better understood by reference to the accompanying drawings and the detailed description that follows.

Thus, there has been summarized above, rather broadly, the more important features and objectives of the present invention in order that the detailed description that follows may be better understood and appreciated. There are, of course, additional features of the invention that will be described hereinafter and which will form the subject matter of any eventual claims to this invention.

DESCRIPTION OF THE PREFERRED EMBODIMENT

Figure 1:
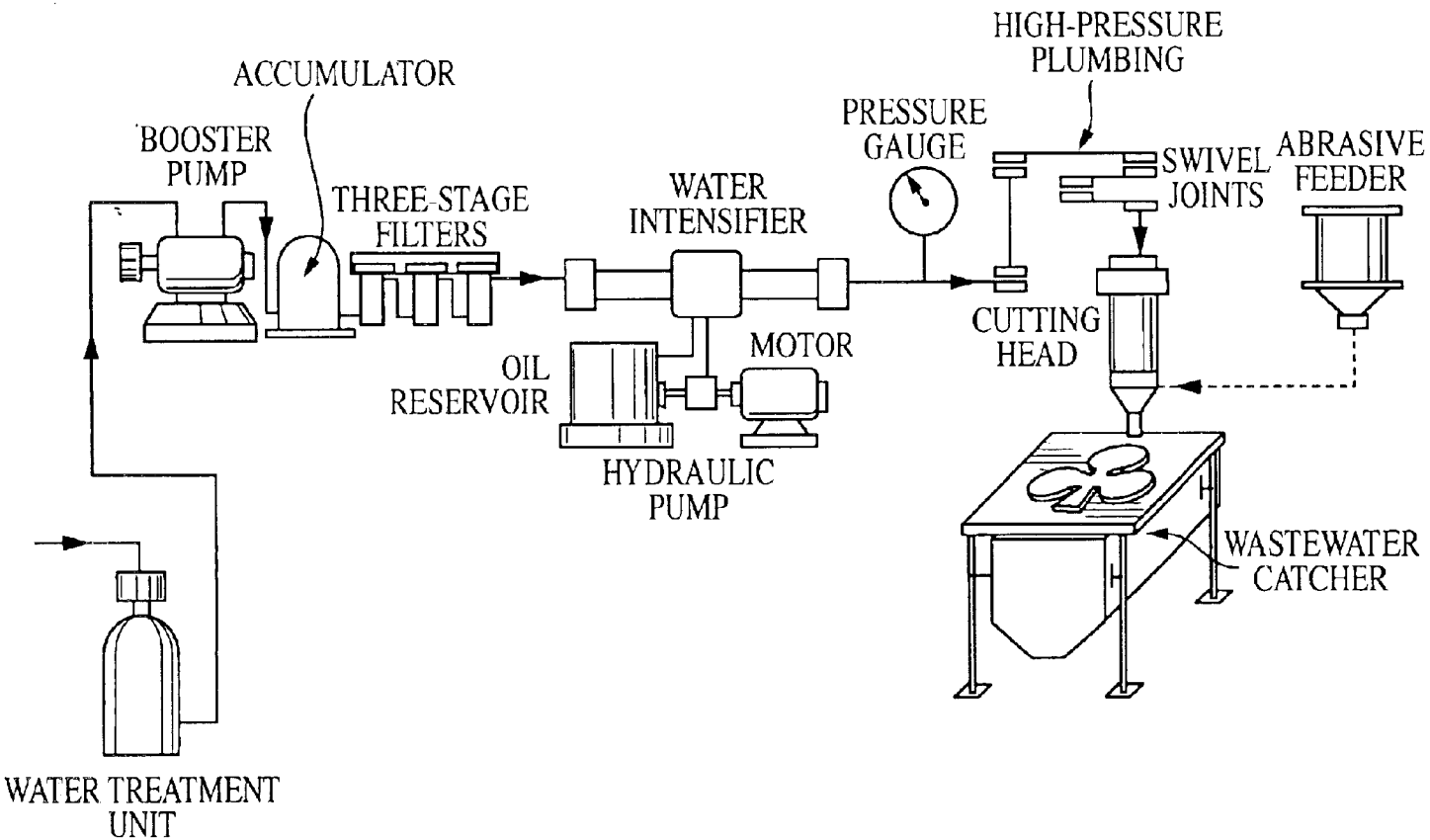
FIG. 1 PRIOR ART
FIG. 1 is a schematic representation of the components of a typical abrasive water jet cutting system.
Figure 2:
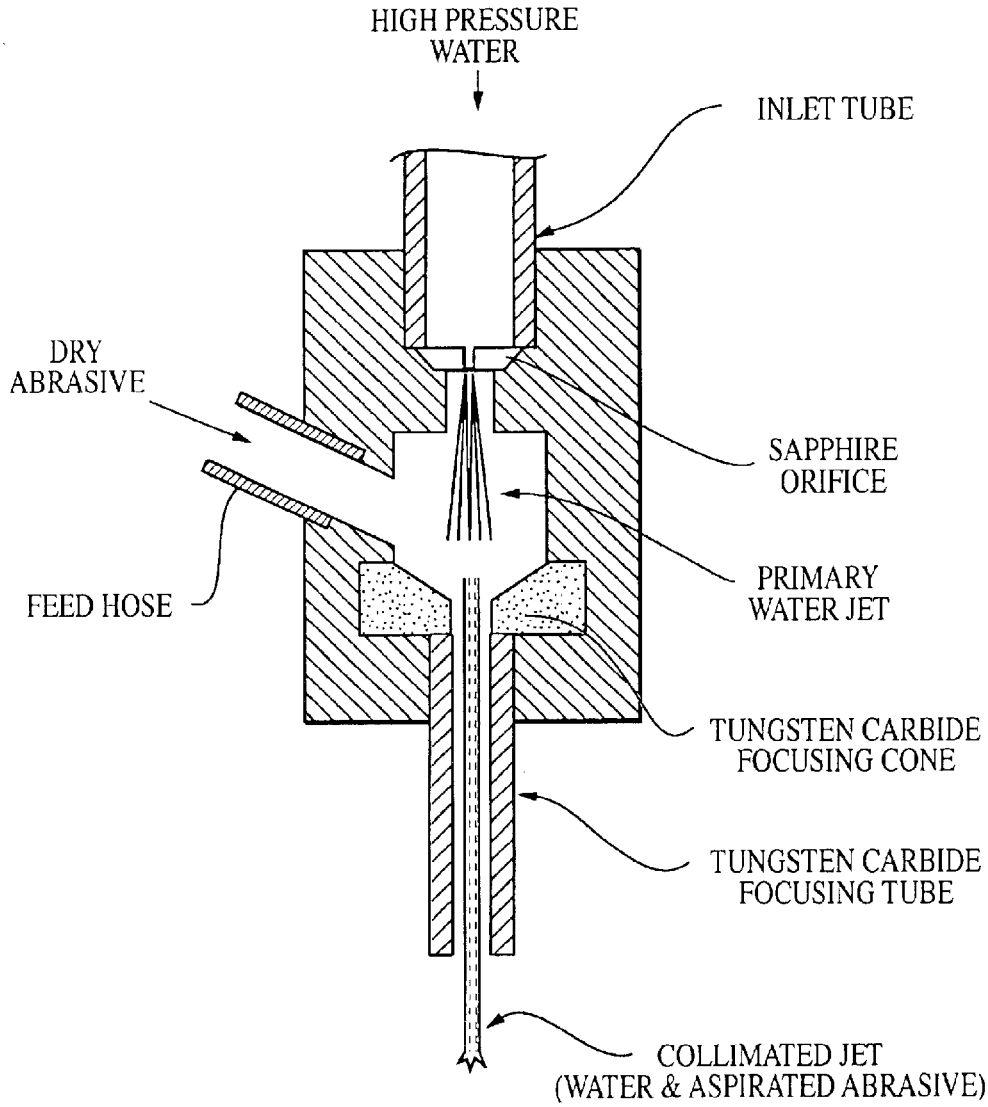
FIG. 2 PRIOR ART
FIG. 2 is a cross-sectional view of the typical cutting head in an abrasive water jet cutting system.
Figure 3:
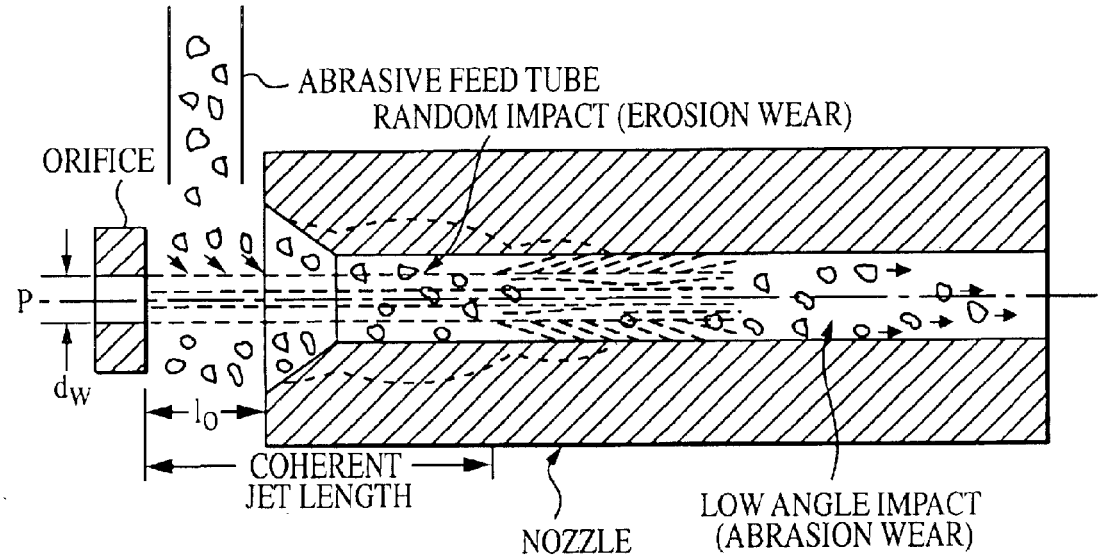
FIG. 3 PRIOR ART
FIG. 3 is schematic representation that illustrates the phenomena associated with wear and erosion of the walls of a mixing tube.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Figure 4:
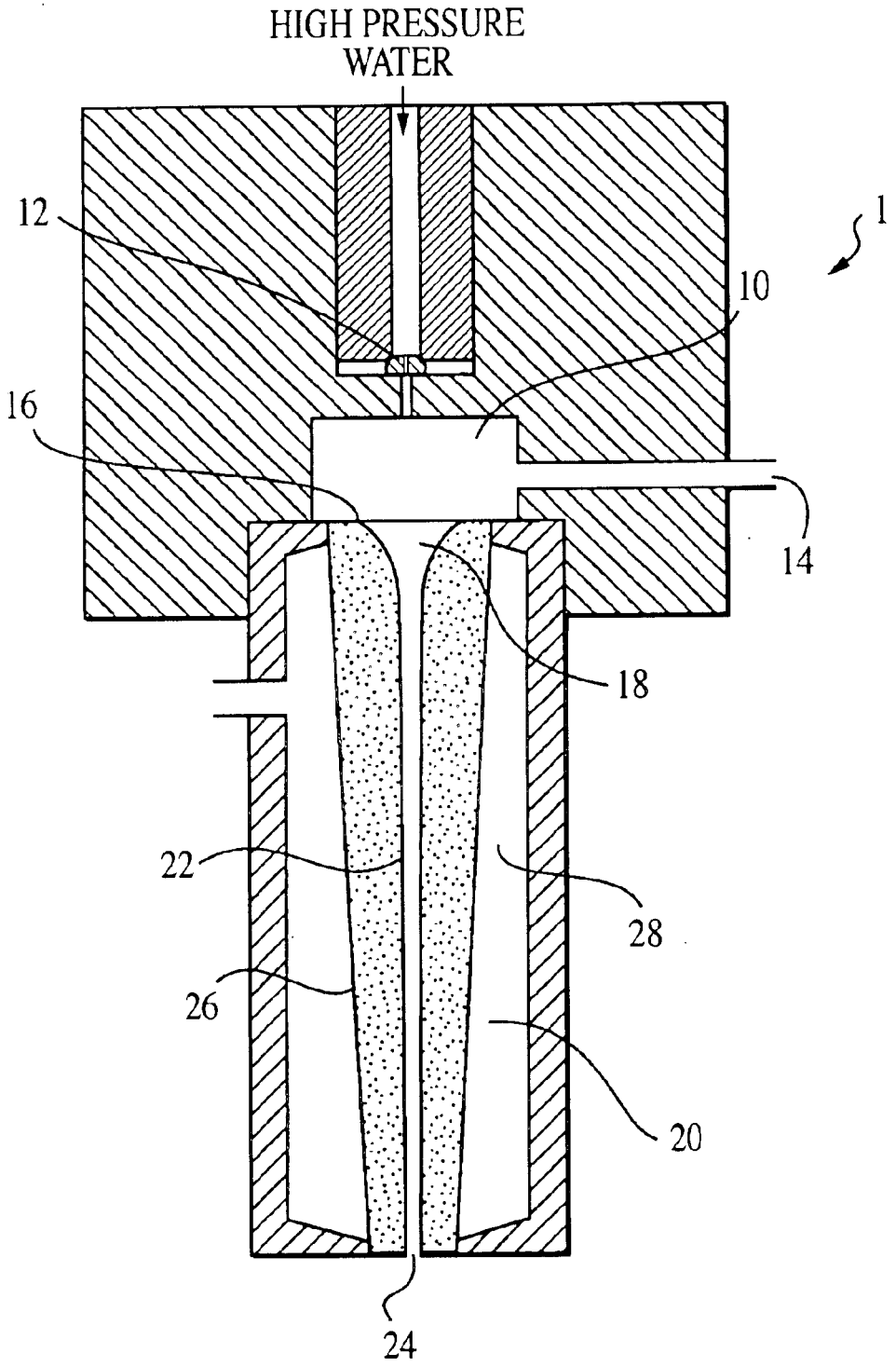
FIG. 4 is a cross-sectional view of a preferred embodiment of an abrasive water jet cutting apparatus of the present invention

Referring now to the drawings wherein are shown preferred embodiments and wherein like reference numerals designate like elements throughout, there is shown in FIG. 4 an abrasive water jet cutting apparatus 1 of the present invention. It consists of a chamber 10 having an inlet orifice 12 through which a high pressure (50–600 MPa or 7.5–90 kpsi), water jet enters the chamber.

The water jet flows through the chamber 10 and entrains abrasive particles that are fed at low pressure through a port 14 in the chamber's sidewall. The abrasive particles combine with the water jet to form a slurry jet that flows from the chamber's exit 16 and enters the entry port 18 of the apparatus'focusing or mixing tube 20.

As shown in FIG. 4, this embodiment utilizes a mixing tube 20 that is constructed from a porous rod through which a central bore has been either machined or cast, thereby resulting in the mixing tube having a perimeter wall 22 that is porous and an exit orifice 24 through which the slurry jet exits the mixing tube 20. The outer wall 26 of the mixing tube is surrounded by an oil or lubricating fluid reservoir 28.

The lubricating fluid reservoir 28 is pressurized so that the lubricating fluid is forced through the porous wall to create a thin film of lubricant on the walls of the mixing tube 20 that serves to protect them from the wear and erosion caused by the passage of the abrasive particles through the tube.

It should be appreciated that the cross sectional form of the jet that exits the mixing tube can be configured to give a variety of shapes by appropriately configuring the cross sectional shape of the mixing tube. For example, the use of a round passage through the mixing tube will yield a round cutting jet, whereas the use of an oval passage thorough the mixing tube would yield an oval cutting jet. All of these various, possible cross sectional shapes are considered to be within the scope of the present invention.

In use, the pressure in the lubricating fluid reservoir is higher than the pressure in the mixing tube 20. Since the lubricant is constantly replenished from the lubricant reservoir 28, sites where abrasive particles "gouge" the lubricant's protective film are "repaired", reducing or preventing damage to the tube's walls. The thickness of the lubricating film is designed to prevent contact (impact) between the particles in the slurry jet and the inner or perimeter wall of the mixing tube and to prevent the high loading stresses on the wall that could lead to its erosion.

An approximated analysis to determine the required thickness of the lubricant layer indicates, for example, that an approximately 10–20 micron thick layer of oil is sufficient to prevent contact between the abrasive particles and the tube wall for a 500 micron diameter, 200 m/sec slurry jet containing 150 micron diameter abrasive particles having a specific gravity of 4 and where the jet fluid is water. For this example, the lubricant's kinematic viscosity should be about 1000 times that of water (at 25° C.). In general, the required thickness of the lubricating film is dependent on the flow conditions, including slurry velocity, mixing tube geometry, abrasive particle specific gravity, shape and void fraction, as well as the viscosity of the lubricating fluid. In most cases, the lubricant film thickness need be only a few percent (about 0.5–6%) of the mixing tube's diameter.

Due to the differences in viscosity between the fluid and the lubricant (typically 100–40,000:1 if oil is used as the lubricant and water is used as the carrier fluid, at 25° C.), and the thinness of the lubricant film, the lubricant flow rate can be kept at a very low level (characteristically, below 1–5% of the carrier fluid flux, and in some cases even as low as 0.01%). Thus, lubricant consumption is relatively minimal.

The lubricant can be of any desired type, so long as the lubricant creates a protective film on the inner wall of the mixing tube 20. Use of liquid polymers provides an additional advantage in situations involving high shear strains ($>10^7$) like those occurring in the mixing tube 20, since liquid polymers tend to "harden" under such conditions (that is, become less of a viscous material and more of a plastic solid). Thus, liquid polymers can absorb much more energy and stresses from laterally moving abrasive particles. Synthetic, light lubricants (such as poly alfa olefins) that can be easily drawn or forced through a porous medium should provide some level of protection to the walls of the mixing tube 20 under low flow conditions. In general, prevention of wear and erosion in the mixing tube 20 improves with increasing lubricating fluid viscosity and with increasing lubricating fluid flow rates.

In the preferred embodiment, the lubricant reservoir 28 and the fluid cutting jet are pressurized from the same source. Due to the high speed flow of the slurry through the mixing tube 20 and the almost stagnant fluid pool in the lubricant reservoir 28, a pressure difference exists between the inner and outer sides of the porous wall of the mixing tube 20 that is generally sufficient to draw the lubricant through the porous wall. The lubricant reservoir 28 can also be pressurized by a separate pump if need be to obtain higher lubricating fluid flow rates.

The mixing tube 20 can be made from a wide range of porous materials, but is preferably made of a hard, moldable or easily machined, porous material. The tube's pore size or its wall thickness can be varied to provide for different lubricant flow rates. Nominal pore sizes of 0.2–20 microns have been found to work well in this application. Further, the mixing tube 20 need not be made completely of porous material. For example, a porous ring could be used upstream from a non-porous, mixing tube exit tip to provide enough lubrication along the inner surface of the tip to substantially reduce its erosion. In a different configuration, the porous ring can be downstream of a non-porous portion, where wear would be greatest. Alternatively, a mixing tube can be configured with stacked multiple porous and non-porous rings. As another alternative, a mixing tube can be configured with stacked multiple porous rings having different lubricant flow rates (for example, due to different porosity or thicknesses).

Moreover, while a uniformly porous material is preferred for the mixing tube 20, in an alternative embodiment, a number of very fine to extremely fine holes can be bored (such as by a laser drill) through a mixing tube formed of non-porous material to make the tube effectively porous.

Various experiments were undertaken to identify the optimal porous material for this application. It was found that gravity sintered materials were more usefull in this application than materials made by pressure compaction followed by sintering. This was due to the fact that porous materials are susceptible to "smearing or blocking" of the pores during their machining for this application, even when using Electric Discharge Machining (EDM). Repeated machining experiments of various nominal pore sizes in the range of 0.2–20 microns showed that EDM of the gravity sintered material, at optimized EDM operating parameters (see below), yielded considerably less smearing than with the pressure compacted, porous materials.

The optimal EDM operating parameters for fabricating the gravity sintered, porous materials utilized low cutting speeds, low energy levels and low spark frequencies with Wire EDM. For example, fabrication of porous, 316-stainless steel, mixing tubes with little smearing can be achieved by utilizing the following EDM parameters: cutting speed=0.38 mm/minute, spark cycle=30 $\mu$sec, wire diameter=0.25 mm brass, with the other parameters being specific to the machine used (i.e., spark energy=20% of max., wire speed=20% of max., wire tension=80% of max., and water conductivity=67% of max.). After machining, the mixing tubes are submerged in a liquid that vaporizes easily, such as methanol, and cleaned using ultrasonic cleaning to remove debris and carbon particles generated during the machining.

As an alternative to machining a gravity sintered, porous material, one may elect to use a porous ceramic material and cast this material in such a manner that the passage connecting a mixing tube's inlet and outlet ports is formed in the original casting of the tube.

The lubricant injection rate is controlled by the pressure difference across the wall of the mixing tube 20, the lubricant viscosity, porous medium permeability, and the thickness of the mixing tube wall. The pressure within the mixing tube 20 is not constant due to the change in slurry's velocity resulting from changes in cross-sectional area of the mixing tube 20 and due to shear stresses along the perimeter wall of the mixing tube 20 nozzle. To insure a desirable lubricant flow rate at every point, the thickness of the porous walls of the mixing tube 20 can be varied. The exact shape of the mixing tube 20 can be determined by solving the equations of motion for fluid flow in the porous medium with the prescribed flow rate at every point as a boundary condition. Thus, it is possible to prescribe a relatively exact injection rate.

The operating efficiency of these porous mixing tubes was found to be considerably increased by filtering the lubricating fluid prior to its injection through the porous material. Without such filtering, the porous material is very prone to become clogged with debris found in the lubricating fluid. Pieces of this same porous material were used to filter the lubricating fluid.

With lubricated walls, the diameter of the mixing tube 20 can be substantially decreased to sizes that are only slightly larger than the diameter of the abrasive particle. For example, if the maximum particle diameter is about 150 microns, the mixing tube diameter can, in principle, be reduced to about 300 microns, including the oil film. Typical tube diameters are in the range of three times the diameter of the chamber's inlet orifice, or on the order of 50–3,000 microns. A smaller mixing tube diameter provides sharper and more precise cuts with less material loss from a workpiece. As a further consequence of lubricating the mixing tube walls exposed to the slurry, the slurry velocity can be increased to considerably higher speeds without damage to the tube's walls, thereby increasing the abrasive power of the slurry and the cutting efficiency of the system.

Although the preferred embodiment of the invention uses liquid as the carrier fluid, the carrier fluid can be a gas or liquid/gas mixture. Further, while the preferred embodiment uses abrasive particles as the principal cutting material, the lubricated mixing tube 20 of the present invention should also reduce wear due to cavitation when used with only highly pressurized cutting liquid. Thus, "abrasive fluid" or "cutting fluid" should be understood to include fluids with or without entrained abrasive particles.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as hereinafter set forth in the claims.

We claim:

1. An abrasive, fluid jet cutting apparatus comprising:

a chamber having an inlet for receiving a pressurized fluid jet, a port for receiving a flow of abrasive particles which are entrained into said fluid jet, and an exit through which said fluid jet and entrained abrasives exit said chamber, a mixing tube having an entry port for receiving said fluid jet and entrained abrasives, an inner wall for directing the flow of said fluid jet and entrained abrasives, and an outlet port through which said fluid jet and entrained abrasives exit said tube, wherein said tube entry port is proximate said chamber exit, a lubricating fluid reservoir that surrounds at least a portion of the outer wall of said mixing tube, wherein at least a portion of said mixing tube wall being porous, wherein said lubricating fluid passes from said lubricating reservoir and through said porous wall to lubricate at least a portion of the surface of said mixing tube wall so as to resist erosion of said tube wall while the fluid jet and entrained abrasives flow through said mixing tube, and wherein said lubricating fluid having a kinematic viscosity whose ratio kinematic viscosity of said jet's carrier fluid is in the range of 100/1–40,000/1.

2. An abrasive, fluid jet cutting apparatus as recited in claim 1, wherein the smallest cross sectional dimension of the passage connecting said mixing tube inlet and outlet ports is in the range of 50–3,000 microns.

3. An abrasive, fluid jet cutting apparatus as recited in claim 1 wherein said abrasive particles have an average diameter of less then half of the smallest cross sectional dimension of the passage connecting said mixing tube and outlet ports.

4. An abrasive, fluid jet cutting apparatus as recited in claim 1, wherein said lubricating fluid has a flow rate whose ratio with the flow rate of the fluid jet and entrained abrasives is in the range of 1/10,000–1/20.

5. An abrasive, fluid jet cutting apparatus as recited in claim 1, wherein the thickness of said mixing tube wall is varied along its length to control the flow rate of the lubricating fluid.

6. An abrasive, fluid jet cutting apparatus as recited in claim 1, wherein said mixing tube wall has variable porosity along its length to control the flow rate of the lubricating fluid.

7. An abrasive, fluid jet cutting apparatus as recited in claim 1, wherein said porous mixing tube being fabricated from a porous ceramic material.

8. An abrasive, fluid jet cutting apparatus as recited in claim 7, wherein the mixing tube passage connecting its inlet and outlet ports is made by a process selected from the group consisting of casting, molding and machining processes for said porous ceramic material.

9. An abrasive, fluid jet cutting apparatus as recited in claim 1, wherein said porous mixing tube being fabricated from a porous metal.

10. An abrasive, fluid jet cutting apparatus as recited in claim 9, wherein the mixing tube passage connecting its inlet and outlet ports is made by a process selected from the group consisting of casting, molding and machining processes for said porous metal.

11. An abrasive, fluid jet cutting apparatus as recited in claim 10, wherein said porous mixing tube being fabricated from a gravity sintered, porous material.

12. An abrasive, fluid jet cutting apparatus as recited in claim 11, wherein the mixing tube passage connecting its inlet and outlet ports is made by using electric discharge machining to machine said porous material, and wherein the porous material for use in fabricating said mixing tube operating parameters for said electric discharge machining of said mixing tube passage are chosen so as to yield minimum blocking of the pores on the machined surface of said mixing tube passage.

13. A method for reducing erosion on the inner wall of a cutting jet, mixing tube due to a fluid with entrained abrasive particles flowing from said tube's inlet port, along said tube's wall and exiting through said tube's outlet port, said method comprises the steps of:

forming said mixing tube so that at least a portion of its wall is porous, surrounding at least a portion of the outer wall of said mixing tube wall with a lubricating fluid reservoir, forcing lubricating fluid to pass from said lubricating reservoir and through said porous wall to form a lubricating film between said mixing tube wall and said flow of abrasive fluid, wherein said lubricating fluid having a kinematic viscosity whose ratio with the kinematic viscosity of said jet's carrier fluid is in the range of 100/1–40,000/1.

14. A method for reducing erosion on the inner wall of said mixing tube as recited in claim 13, wherein the smallest cross sectional dimension of the passage connecting said mixing tube inlet and outlet ports is in the range of 50–3,000 microns.

15. A method for reducing erosion on the inner wall of said mixing tube as recited in claim 13, wherein said abrasive particles have an average diameter of less then half of the smallest cross sectional dimension of the passage connecting said mixing tube inlet and outlet port.

16. A method for reducing erosion on the inner wall of said mixing tube as recited in claim 13, wherein said lubricating fluid has a flow rate whose ratio with the flow rate of the fluid jet and entrained abrasives is in the range or 1/10,000–1/20.

17. A method for reducing erosion on the inner wall of said mixing tube as recited in claim 13, wherein the thickness of said mixing tube is varied along is length to control the flow rate of the lubricating fluid.

18. A method for reducing erosion on the inner wall of said mixing tube as recited inn claim 13, wherein said mixing tube wall has variable porosity along its length to control the flow rate of said lubricating fluid.

19. A method for reducing erosion on the inner wall of said mixing tube as recited in claim 13, wherein said porous mixing tube being fabricated from a porous ceramic material.

20. A method for reducing erosion on the inner wall of said mixing tube as recited in claim 19, wherein the mixing tube passage connected its inlet and outlet ports is made by a process selected from the group consisting of casting, molding and machining processed for said porous ceramic material.

21. A method for reducing erosion on the inner wall of said mixing tube as recited in claim 13, wherein said porous mixing tube being fabricated from a porous metal.

22. A method for reducing erosion on the inner wall of said mixing tube as recited in claim 21, wherein the mixing tube passage connecting its inlet and outlet ports is made by a process selected from the group consisting of casting, molding and machining processes for said porous metal.

23. A method for reducing erosion on the inner wall of said mixing tube as recited in claim 13, wherein said porous mixing tube being fabricated from a gravity sintered, porous material.

24. A method for reducing erosion on the inner wall of said mixing tube as recited in claim 23, wherein the mixing tube passage connecting its inlet and outlet ports is made by using discharge machining to machine said mixing tube and the operating parameters for said electric discharge machining of said mixing tube passage are chosen so as to yield minimum blocking of the pores on the machined surface of said mixing tube passage.

25. A mixing tube apparatus for use with an abrasive, fluid jet cutting system, said system comprising a chamber having an inlet for receiving a pressurized fluid jet, a port for receiving a flow of abrasive particles which are entrained into said fluid jet, and an exit through which said fluid jet and entrained abrasives exit said chamber, wherein said mixing tube apparatus comprising:

a mixing tube having an entry port for receiving said fluid jet and entrained abrasives, an inner wall for directing the flow of said fluid jet and entrained abrasives, and an outlet port through which said fluid jet and entrained abrasives exit said tube, wherein said tube entry port is fixed proximate said chamber exit, a lubricating fluid reservoir that surrounds at least a portion of the outer wall of said mixing tube, wherein at least a portion of said mixing tube wall being porous, wherein said lubricating fluid passes from said lubricating reservoir and through said porous wall to lubricate at least a portion of the surface of said mixing tube wall so as to resist erosion of said tube wall while the fluid jet and entrained abrasives flow through said mixing tube, and wherein said lubricating fluid having a kinematic viscosity whose ratio with the kinematic viscosity of said jet's carrier fluid is in the range of 100/1–40,000/1.

26. A mixing tube apparatus as recited claim 25, wherein the smallest cross sectional dimension of the passage connecting said mixing tube inlet and outlet ports is in the range of 50–3,000 microns.

27. A mixing tube apparatus as recited in claim 25, wherein said abrasive particles have an average diameter of less than half of the smallest cross sectional dimension of the passage connecting said mixing tube inlet and outlet and ports.

28. A mixing tube apparatus as recited in claim 25, wherein said lubricating fluid as a flow rate whose ratio with the rate of the fluid jet and entrained abrasives is in the range of 1/10,000–1/20.

29. A mixing tube apparatus as recited in claim 25, wherein said thickness of said mixing tube wall is varied along its length to control the flow rate of the lubricating fluid.

30. A mixing tube apparatus as recited in claim 25, wherein said mixing tube wall has variable porosity along its length to control the flow rate of the lubricating fluid.

31. A mixing tube apparatus as recited in claim 25, wherein said porous mixing tube being fabricated from a porous ceramic material.

32. A mixing tube apparatus as recited in claim 31, wherein the mixing tube passage connecting its inlet and outlet ports is made by a process selected from the group consisting of casting, molding and machining processes for said porous ceramic material.

33. A mixing tube apparatus as recited in claim 25, wherein said porous mixing tube being fabricated from a porous metal.

34. A mixing tube apparatus as recited in claim 33, wherein the mixing tube passage connecting its inlet and outlet ports is made by a process selected from the group consisting of casting, molding and machining processes for said porous material.

35. A mixing tube apparatus as recited in claim 34, wherein said porous mixing tube being fabricated from a gravity sintered, porous material.

36. A mixing tube apparatus as recited in claim 35, wherein the mixing tube passage connecting its inlet and outlet ports is made by using electric discharge machining to machine said porous material, and wherein the porous material for use in fabricating said mixing tube and the operating parameters for said electric discharge machining of said mixing tube passage are chosen so as to yield minimum blocking of the pores on the machined surface of said mixing tube passage.

37. A mixing tube for use with an abrasive, fluid jet cutting system said system comprising a chamber having an inlet for receiving a pressurized fluid jet, A port for receiving a flow of abrasive particles which are entrained into said fluid jet, and an exit through which said jet and entrained abrasives exit said chamber, wherein said mixing tube having:

an entry port for receiving said fluid jet and entrained abrasives, an inner wall for directing the flow of said fluid jet and entrained abrasives, and an outlet through which said fluid jet and entrained abrasives exit said tube, wherein said tube entry port is fixed proximate said chamber exit, wherein at least a portion of said mixing tube wall being porous, wherein at least a portion of said mixing tube when i use being surrounded by a lubricating fluid reservoir, wherein said lubricate fluid passes from said lubricating reservoir and through said porous wall to lubricate at least a portion of the surface of said mixing tube wall so as to resist erosion of said tube wall while the fluid jet and entrained abrasives flow through said mixing tube, and wherein said lubricating fluid having a kinematic viscosity whose ratio with the kinematic viscosity of said jet's carrier fluid is in the range of 100/1–40,000/1.

38. A mixing tube as recited in claim 37, wherein the smallest cross sectional dimension of the passage connecting said mixing tube inlet and outlet ports is in the range of 50–3,000 microns.

39. A mixing tube as recited in claim 37, wherein said abrasive particles have an average diameter of less than half of the smallest cross sectional dimension of the passage connecting said mixing tube inlet ports.

40. A mixing tube as recited in claim 37, wherein said lubricating fluid has a flow rate whose ratio with the flow rate of the fluid jet and entrained abrasives is in the range of 1/10,000–1/20.

41. A mixing tube as recited in claim 37, wherein the thickness of said mixing tube wall is varied along its length to control the flow rate of the lubricating fluid.

42. A mixing tube as recited in claim 37, wherein said mixing tube wall has variable porosity along its length to control the flow rate of the lubricating fluid.

43. A mixing tube as recited in claim 37, wherein said porous mixing tube being fabricated from a porous ceramic material.

44. A mixing tube as recited in claim 43, wherein the mixing tube passage connecting its inlet and outlet ports is made by a process selected from the group consisting of casting, molding and machining processes for said porous ceramic material.

45. A mixing tube as recited in claim 37, wherein said porous mixing tube being fabricated from a porous metal.

46. A mixing tube as recited in claim 45, wherein the mixing tube passage connecting its inlet and outlet ports is made by a process selected from the group consisting of casting, molding and machining processes for said porous metal.

47. A mixing tube as recited in claim 46, wherein said porous mixing tube being fabricated from a gravity sintered, porous material.

48. A mixing tube as recited in claim 47, wherein the mixing tube passage connecting its inlet and outlet ports is made by using electric discharge machining to machine tube wall so as to resist erosion of said tube wall while the fluid jet and entrained said porous material, and wherein the porous material for use in fabricating said mixing tube and the operating parameter for said electric discharge machining of said mixing tube passage are chosen so as to yield minimum blocking of the pores on the machined surface of said mixing tube passage.

* * * * *